US005874872A

United States Patent [19]

Karhu et al.

[11] Patent Number: 5,874,872

[45] Date of Patent: Feb. 23, 1999

[54] FILTER

[75] Inventors: Kimmo Karhu, Oulu; Markku J. Tiihonen, Tyrnävä; Anssi Kotanen, Oulu; Markku Pirhonen, Kempele, all of Finland

[73] Assignee: ADC Solitra Oy, Kempele, Finland

[21] Appl. No.: 851,446

[22] Filed: May 5, 1997

[30] Foreign Application Priority Data

May 7, 1996 [FI] Finland ..... P61940

[51] Int. Cl.[6] ..... H01P 1/20; H01P 7/00

[52] U.S. Cl. ..... 333/202; 333/234; 333/235; 333/219

[58] Field of Search ..... 333/202, 206, 333/219, 222, 234, 207, 235

[56] References Cited

U.S. PATENT DOCUMENTS

| | | | |
|---|---|---|---|
| 3,706,948 | 12/1972 | Choi et al. | 333/207 |
| 4,059,815 | 11/1977 | Makimoto et al. | 333/202 X |
| 4,129,842 | 12/1978 | Torii et al. | 333/219 X |
| 5,418,508 | 5/1995 | Puurunen | 333/202 |
| 5,691,675 | 11/1997 | Hatanaka | 333/202 |

FOREIGN PATENT DOCUMENTS

| | | |
|---|---|---|
| 0703634 | 3/1996 | European Pat. Off. . |
| 80163 | 9/1988 | Finland . |
| 80811 | 9/1988 | Finland . |
| 90157 | 5/1990 | Finland . |
| 1170020 | 5/1964 | Germany . |
| 9117583 | 11/1991 | WIPO . |

*Primary Examiner*—Seungsook Ham
*Attorney, Agent, or Firm*—Ladas & Parry

[57] ABSTRACT

A filter has a shell construction including a connection surface and a bar-like resonator in the shell construction. The bar-like resonator has an initial section having one end region thereof connected to the connection surface of the shell construction and an opposite end region. A substantially straight and elogate intermediate section extends from the opposite end region of the initial section to an end and a turning-point section extends from the end of the intermediate section to an end. A substantially straight and elongate end section has one end connected to the end of the turning-point section so as to extend adjacent to the intermediate section and supporting means connect to the connection surface of the shell construction for supporting the bar-like reasonator at least at one of the end section and turning-point.

19 Claims, 2 Drawing Sheets

FILTER

BACKGROUND OF THE INVENTION

The invention relates to a filter comprising a shell construction and at least one resonator in the shell construction, the resonator having a turning point where the coaxial resonator turns backwards and in which filter the coaxial resonator is attached to a connection surface included in the shell construction.

Radio-frequency filters, such as resonator filters are used for implementing high frequency circuits in base stations of mobile telephone networks, for example. Filter constructions can be used, for example, as interface and filtering circuits in the amplifiers of transmitter and receiver units in base stations.

There are several different types of resonator filters comprising a shell construction, or a body: e.g. a coaxial resonator filter and an L-C filter. The present solution relates to coaxial resonators. In addition, for example, a helix resonator and a cavity resonator construction are known. All these resonator types comprise a metallic shell construction. In coaxial resonator constructions, for example, the shell envelops a conductor which is positioned in the middle of the shell and which is called a resonator or a resonator pin. In helix resonators the wire of the resonator is wound into a spiral coil. A cavity resonator only comprises a cavity.

As the size of the equipments requiring filters has become smaller, it has become necessary to make the resonator small-sized. To reduce the space required by the resonator, a helix coil is used where the same operational length will be in a shorter space because the resonator in the helix resonator has been formed as a coil. A helix coil is, however, difficult to manufacture, and a further disadvantage is that it very difficult to attach to the helix coil a wiring connection or other such projection which is needed when the switching between two resonance circuits is to be adjusted. A further problem with helix resonators is that it is difficult to support them and carry out temperature compensation. References FI-80163, FI-80811 and FI-90157 disclose supports of helix resonators where the annular lower edge of the helix resonator coil rests on the surface to which the helix is attached. But as mentioned, it is difficult to support a helix resonator and the manufacturing of the actual helix is difficult in comparison to a bar-like coaxial resonator.

In coaxial resonators, a resonator is normally a straight pin which is connected only to the bottom of the resonator. This type of resonator is long and thus takes up a lot of space.

A coaxial resonator type, which is U-shaped, that is, comprises a turning point, is also known. Such a construction allows a smaller size but its manufacturing is problematic because the connection of the initial section and the support of the end section of the resonator will be on different surfaces wherefore the manufacture and installation of the filter will become considerably more difficult.

SUMMARY OF THE INVENTION

The object of the present invention is to provide a new type of filter which obviates the problems associated with the known solutions.

This object is achieved with a filter of the invention, which is characterized in that the resonator rests on a supporting means which is attached to the same connection surface to which the coaxial resonator is attached, and that the support of the resonator is such that the support of the resonator against this same connection surface is arranged in the essentially straight section of the resonator after the turning point of the resonator and/or in the area of the turning point preceding this essentially straight section.

Several advantages are attained with the solution of the invention. The invention enables a small-sized resonator without needing to use a complicated helix construction. It is easy and economic to install the filter as the resonators can be connected to and rest on the same surface, that is, most preferably in practice on the bottom of the filter, and the walls and the cover of the shell construction can be positioned as separate sections on the bottom of the shell construction and the resonators on top of it. Applicant has observed that a good quality factor, i.e. a good Q factor can be attained with the new construction. The preferred embodiments of the invention and other details emphasize the advantages of the invention. The support of the coaxial resonator of the invention also allows the form of the coaxial resonator to be still easily manufactured and modifiable. Modifiability means that frequency bands settling at different frequencies can be implemented in such a manner that the length of the straight area which is the support area, or the length of the straight area which is after the support area, i.e. the end section of the resonator, is cut shorter or left longer.

BRIEF DESCRIPTION OF THE DRAWING

In the following, the invention will be explained in more detail by means of the appended drawings, wherein.

DESCRIPTION OF PREFERRED EMBODIMENTS

Figure 1:
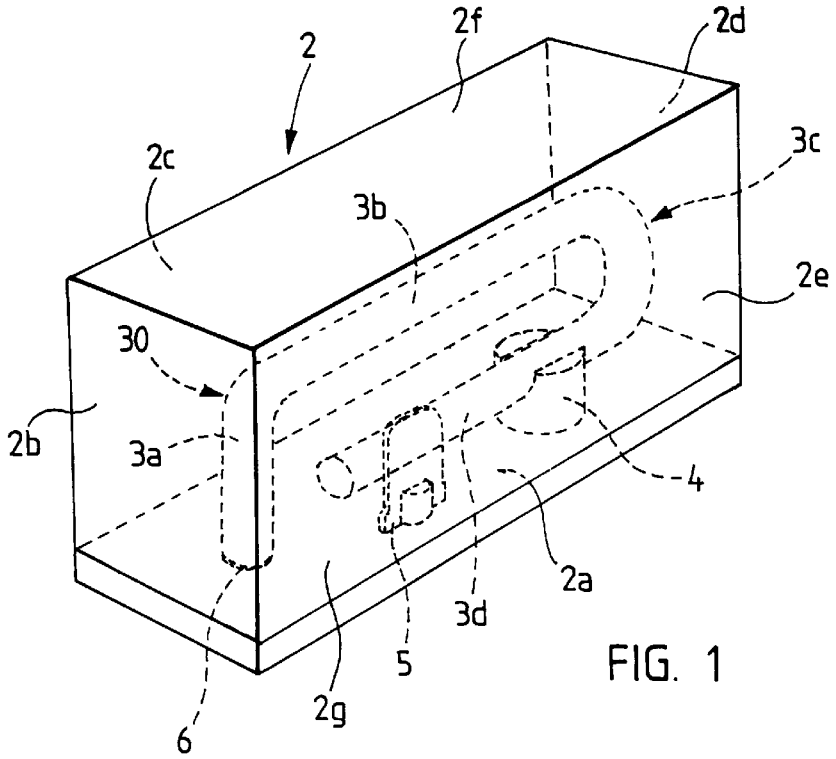
FIG. 1 shows a resonator of a single-circuit filter in its shell.
Figure 2:
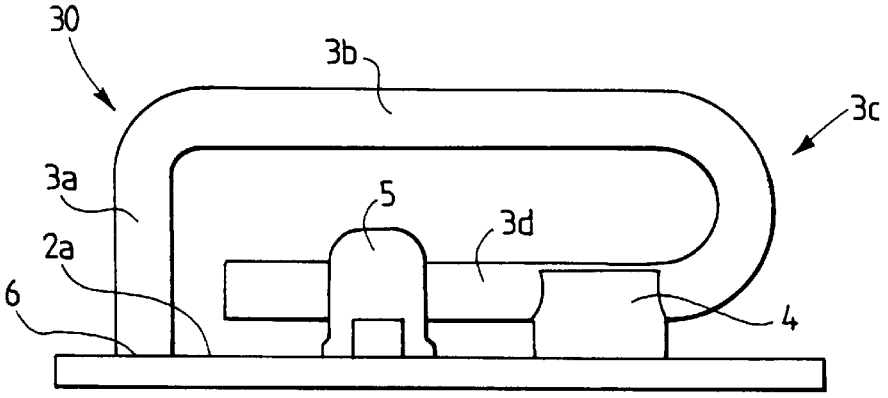
FIG. 2 is a side view of the resonator shown in FIG. 1 on the bottom of the shell construction.
Figure 3:
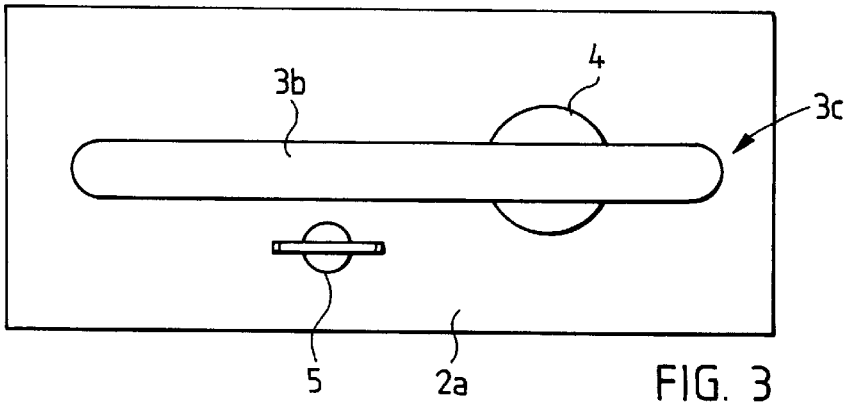
FIG. 3 is a top view of the resonator shown in FIG. 1 on the bottom of the shell construction.

With reference to FIGS. 1 to 3, it is first stated that the invention relates to an RF filter, i.e. a radio-frequency filter, comprising a shell construction 2 and at least one resonator 30 in the shell construction. The shell construction 2 comprises a bottom 2*a*, walls 2*b* to 2*e* and a cover 2*f*. The shell construction 2 defines a compartment 2*g* where the resonator is located. Both the shell construction and the resonator are naturally of an electroconductive material. The resonator 30 is formed for example of a thin copper wire having a thickness of 1.5 mm, for instance. The shell construction 2 may be of aluminium, for example. In the filter, the resonator 30 may be attached to a connection surface included in the shell construction, which is the bottom 2*a* of the shell construction in the preferred embodiment. The connection is carried out at a connection point 6. The connection point 6 can be a soldered joint, a screw joint or some other joint, or the resonator may be integrated as an integral part of the bottom 2*a*. In the drawings e.g. a soldered joint or a screw joint is used.

It can be seen in FIGS. 1 and 2 that at some point along the resonator from the connection point 6, and at the opposite end section of the resonator at the latest, the resonator rests on a supporting means 4 which is attached to the same connection surface bottom 2*a* to which the resonator is attached. Thus the resonator successively comprises an initial section 3*a* extending from the connection surface bottom 2*a*, an intermediate section 3*b*, a turning-point section 3*c* where the resonator turns backwards, and an end section 3*d*. In the preferred embodiment of the invention, the supporting means 4 bears on the resonator and connection surface bottom 2*a* in the area of the turning-point section 3*c* of the resonator and/or in the area after the turning point, that is precisely, according to the figures, in the end section 3*d* of the resonator some distance after the turning point 3*c*. This kind of a resonator is easy to manufacture, and in accordance with the invention, it makes it possible to attach it to and rest it on the same surface, that is, in practice, the bottom 2*a* of the shell construction.

The supporting means 4 for the resonator is arranged in the end section 3*d* of the resonator, which is essentially straight after the turning point 3*c* of the resonator and/or in the area of the turning point 3*c* of the resonator preceding this essentially straight end section 3*d*.

In the preferred embodiments of the invention the resonator is a bar-like resonator since the Applicant has observed that this provides a better Q factor than a strip-like construction, for example. A resonator formed of a sufficiently rigid metallic wire can be interpreted as being a bar-like resonator.

As was mentioned above, in the preferred embodiment of the invention, the filter is such that the connection surface 2*a* included in the shell construction 2, to which surface to the resonator 3 is attached and on which the turning point 3*c* and/or the section 3*d* of the resonator after the turning point 3*c* rests, is the bottom 2*a* of the shell construction of the filter. In this case the manufacture and installation of the filter will be as easy as possible.

In the filter, a temperature rise may extend the length of the resonator 3 and thus lower resonance frequency. On the other hand, a temperature rise may cause the end section 3*d* of the resonator to straighten and come closer to the bottom 2*a* of the shell construction, in which case the capacitance between the bottom 2*a* and the resonator would change as the distance becomes shorter. To eliminate these disadvantages, that is, to effect temperature compensation at the same time, the solution in the preferred embodiment of the invention is such that a supporting means 4 is used in the support between the resonator and the connection surface 2*a* (the bottom 2*a*), the supporting means 4 extending its length due to heat. Teflon is a suitable material for the supporting means 4.

In the embodiment of the figures, because of heat and straightening, the end section 3*d* of the resonator 3 and the bottom 2*a* will come closer. In that case the solution in the preferred embodiment of the invention is such that the supporting means 4 extends its length due to heat, whereby the supporting means, such as a piece of teflon makes the distance greater between the resonator and the surface 2*a*, that is, the bottom 2*a*, compensating the disadvantageous effect in the opposite direction.

It can be seen in the figures that in the preferred embodiment of the invention, the filter further comprises a means 5 for adjusting the resonance frequency of the filter and that the means 5 for adjusting the resonance frequency of the filter is attached to the same connection surface 2*a* to which the resonator is attached and on which the turning point and/or the end section of the resonator after the turning point 3*c* rests. In that case, all the important constructions, that is, the connection, support, temperature compensation of the resonator, and thus in this preferred embodiment also the means 5 for adjusting the resonance frequency of the filter are attached to the same connection surface 2*a*, that is, the bottom 2*a*.

It can be seen in the figures that in the preferred embodiment of the invention, the filter is such that the end section 3*d* of the resonator after the turning point 3*c* extends close to the connection point 6, that is, the joint of the resonator and its connection surface 2*a*. The initial section 3*a* and the end section 3*d* of the resonator are thus close to one another. The Applicant has observed that a better quality factor, i.e. Q factor is then attained. The Applicant has observed that a quality factor of over 1,400 can be attained with the method of the invention. For example, resonance frequency and the size of the resonator and the shell also have an effect on the quality factor.

It can be seen in particular in FIG. 3 that the resonator one plane. This kind of a resonator lies substantially is easy to manufacture and install.

With reference to FIGS. 1 to 3, in the preferred embodiment of the invention, the end section of the resonator is directed at least approximately towards the initial section of the resonator. The Applicant has noticed that in this way the quality factor, i.e. the Q factor is improved and the resonator is maintained on a plane.

Figure 4:
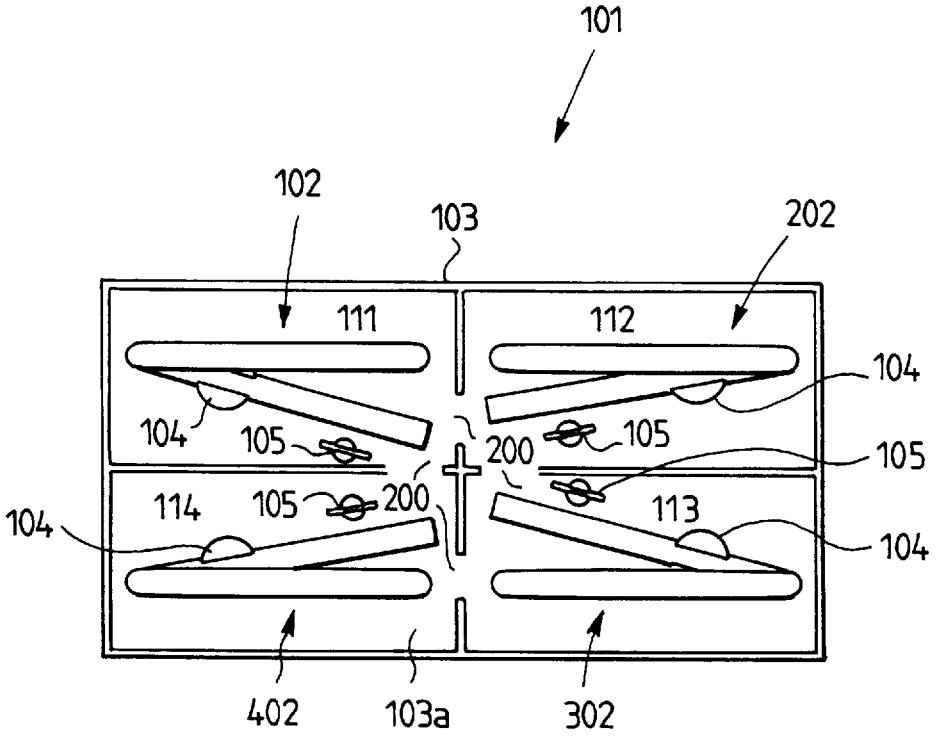
FIG. 4 shows a 4-circuit filter.

The embodiment of FIG. 4 will be discussed in the following. FIG. 4 shows a filter 101, which is a multi-circuit filter and comprises several resonators 102, 202, 302, 402, and a shell construction 103 comprising compartments 111 to 114, that is, a compartment for each resonator 102, 202, 302, 402. Each of the compartments 111 to 114 together with corresponding resonators 102, 202, 302, 402 form a specific resonance circuit. In a multi-circuit resonance filter construction, the resonance circuits are arranged to one another by means of a switching element so that the resonator construction realizes a desired frequency response in the frequency range. By means of the switching of resonance circuits, the resonance circuits are connected to the resonator circuit next in the switch diagram of the filter.

FIG. 4 also illustrates resonance-specific adjustment means 105 for adjusting the resonator frequency of the filter. Supporting means can also be seen there. Reference numeral 103*a* illustrates the common bottom of the shell construction.

With reference to FIG. 4, in the preferred embodiment the end section of the resonator is directed past the initial section of the resonator. In this way a good quality factor, i.e. Q factor is attained.

It can be seen in FIG. 4 that in the preferred embodiment of the invention, different resonators are directed to the vicinity of one or more adjacent circuits of a resonator. Then it possible to carry out switching between adjacent resonator circuits more easily. The shell construction should have openings 200 between the compartments of the shell construction to enable switching between resonator circuits.

The Q factor can be even further improved with some preferred embodiments of the invention and the construction of the coaxial resonator can still remain suitably simple to manufacture and install.

In one such preferred embodiment the initial section 3*a* of the resonator is essentially straight as then the construction of the resonator will remain simple.

Correspondingly and for this same reason in one preferred embodiment, the intermediate section 3*b* after the turning area 30 subsequent to the initial section 3*a* of the coaxial resonator is essentially straight. In one such preferred embodiment, the initial section 3*a* of the resonator extends essentially at a straight angle outwards from the connection surface. Then there will be sufficient distance with respect to the connection surface 2*a* and the resonator is provided with more length.

In another preferred embodiment, the intermediate section 3*b* of the resonator extends essentially in the same direction as the connection surface.

In one preferred embodiment, the section 3*d* of the resonator after the turning point 3*c* extends essentially in the same direction as the connection surface 2*a*.

In one preferred embodiment, the intermediate section 3*b* of the resonator is at least approximately at a straight angle with respect to the initial section 3*a* of the bar-like coaxial resonator.

In one preferred embodiment, the intermediate section 3*b* of the resonator and the end section 3*d* after the turning point are essentially parallel, having a constant distance from one another.

All the above preferred embodiments improve the advantages of the invention, especially with regard to manufacture, installation and the Q factor.

Although the invention has been described above with reference to the examples illustrated in the accompanying drawings, it will be clear that the invention is not restricted to these examples but can be modified in many ways within the inventive concept disclosed in the appended claims.

We claim:

1. In a filter having a shell construction including a connection surface and a bar-like resonator in the shell construction, the improvements of the bar-like resonator comprising:

an initial section having one end region thereof connected to the connection surface and an opposite end region;

a substantially straight and elongate intermediate section that extends from the opposite end region of the initial section to an end;

a turning-point section that extends from the end of the intermediate section to an end;

a substantially straight and elongate end section having one end connected to the end of the turning-point section so as to extend adjacent to the intermediate section; and supporting means connected to the connection surface for supporting the bar-like resonator at least at one of the end section and turning-point section; wherein the intermediate and end sections of the bar-like resonator are substantially parallel to one another.

2. The filter according to claim 1, wherein the connection surface is a bottom of the shell construction.

3. The filter according to claim 1, wherein at least part of the supporting means has a temperature dependence for temperature compensation of the bar-like resonator.

4. The filter according to claim 3, wherein the temperature dependence of the supporting means causes an extension of its length with increased heat.

5. The filter according to claim 1, and further comprising a means attached to the connection surface for adjusting a resonance frequency of the filter.

6. The filter according to claim 1, wherein the end section of the bar-like resonator extends to at least close to the one end region of the initial section of the bar-like resonator.

7. The filter according to claim 1, wherein the intermediate, turning-point and end sections of the bar-like resonator lie in substantially one plane.

8. The filter according to claim 6, wherein the end section of the bar-like resonator extends past the initial section of the bar-like resonator.

9. The filter according to claim 1, and further comprising at least one other resonator having the same configuration as the bar-like resonator, wherein the connection surface is common to the resonators.

10. The filter according to claim 9, wherein the end sections of the bar-like resonators extend to the vicinity of each other.

11. The filter according to claim 1, wherein the initial section of the bar-like resonator is substantially straight.

12. The filter according to claim 11, wherein the initial section of the bar-like resonator extends substantially perpendicularly to the connection surface.

13. The filter according to claim 11, wherein the intermediate section of the bar-like resonator extends substantially parallel to the connection surface.

14. The filter according to claim 11, wherein the end section of the bar-like resonator extends substantially parallel to the connection surface.

15. The filter according to claim 11, wherein the intermediate section of the bar-like resonator is substantially perpendicular to the initial section of the bar-like resonator.

16. The filter according to claim 3, and further comprising a means attached to the connection surface for adjusting a resonance frequency of the filter.

17. The filter according to claim 3, wherein the end section of the bar-like resonator extends to at least close to the one end region of the initial section of the bar-like resonator.

18. The filter according to claim 16, wherein the end section of the bar-like resonator extends to at least close to the one end region of the initial section of the bar-like resonator.

19. The filter according to claim 18, wherein the intermediate section of the bar-like resonator extends substantially parallel to the connection surface.

* * * * *

UNITED STATES PATENT AND TRADEMARK OFFICE

CERTIFICATE OF CORRECTION

PATENT NO. : 5,874,872

DATED : February 23, 1999

INVENTOR(S) : Karhu et al.

It is certified that error appears in the above-identified patent and that said Letters Patent is hereby corrected as shown below:

On the title page, Item 30, "P61940" should be – – 961940– – .

Signed and Sealed this

Seventh Day of September, 1999

*Attest:*

Q. TODD DICKINSON

*Attesting Officer*

*Acting Commissioner of Patents and Trademarks*